US007900564B2

(12) United States Patent
Ramser et al.

(10) Patent No.: US 7,900,564 B2
(45) Date of Patent: Mar. 8, 2011

(54) RAIL CAR AND METHOD FOR TRANSPORT OF BULK MATERIALS

(75) Inventors: Jack E. Ramser, Muscatine, IA (US); Peter A. Miller, Davenport, IA (US); Robert J. Willis, Muscatine, IA (US); John P. Dudenhoeffer, Muscatine, IA (US)

(73) Assignee: Grain Processing Corporation, Muscatine, IA (US)

( * ) Notice: Subject to any disclaimer, the term of this patent is extended or adjusted under 35 U.S.C. 154(b) by 925 days.

(21) Appl. No.: 11/275,557

(22) Filed: Jan. 13, 2006

(65) Prior Publication Data

US 2007/0163462 A1 Jul. 19, 2007

(51) Int. Cl.
*B61D 3/00* (2006.01)

(52) U.S. Cl. ..... 105/355; 222/195; 414/339

(58) Field of Classification Search ..... 214/500; 105/355; 414/339
See application file for complete search history.

(56) References Cited

U.S. PATENT DOCUMENTS

| | | | | | |
|---|---|---|---|---|---|
| 3,139,998 | A * | 7/1964 | Seaman | 414/539 |
| 3,604,578 | A * | 9/1971 | Smith | 414/467 |
| 3,941,258 | A * | 3/1976 | Ide | 414/304 |
| 3,951,284 | A * | 4/1976 | Fell et al. | 414/812 |
| 4,138,163 | A * | 2/1979 | Calvert et al. | 406/129 |
| 4,497,259 | A * | 2/1985 | Titterton | 105/359 |
| 4,541,765 | A * | 9/1985 | Moore | 414/267 |
| 4,557,400 | A * | 12/1985 | Clarke | 222/105 |
| 4,630,988 | A * | 12/1986 | LaRue | 414/327 |
| 4,735,457 | A * | 4/1988 | Bonerb et al. | 298/27 |
| 4,771,702 | A * | 9/1988 | Pavlick | 105/4.1 |
| 4,795,301 | A * | 1/1989 | Snead et al. | 414/339 |
| 4,909,156 | A * | 3/1990 | Erickson | 105/359 |
| 4,925,356 | A * | 5/1990 | Snead et al. | 414/339 |
| 5,402,732 | A * | 4/1995 | Erickson et al. | 105/359 |
| 5,794,539 | A * | 8/1998 | Ott et al. | 105/377.08 |
| 5,823,225 | A * | 10/1998 | Erickson et al. | 137/347 |
| 6,401,983 | B1 * | 6/2002 | McDonald et al. | 222/181.2 |
| 6,588,345 | B1 * | 7/2003 | Aguirre et al. | 105/247 |
| 6,835,041 | B1 * | 12/2004 | Albert | 414/386 |
| 7,231,947 | B2 * | 6/2007 | Boroch et al. | 141/286 |
| 2002/0157563 | A1 * | 10/2002 | Richmond et al. | 105/247 |
| 2002/0162480 | A1 * | 11/2002 | Winant | 105/355 |
| 2003/0194301 | A1 * | 10/2003 | Pfeiffer et al. | 414/373 |
| 2003/0235473 | A1 * | 12/2003 | Wysong et al. | 406/39 |
| 2004/0146382 | A1 * | 7/2004 | Schmid | 414/403 |
| 2006/0185552 | A1 * | 8/2006 | Herzog et al. | 105/247 |
| 2006/0198721 | A1 * | 9/2006 | Harrold | 414/378 |
| 2007/0048113 | A1 * | 3/2007 | McMahon et al. | 414/467 |
| 2007/0065261 | A1 * | 3/2007 | Chambers et al. | 414/435 |
| 2007/0163462 | A1 * | 7/2007 | Ramser et al. | 105/355 |
| 2007/0210080 | A1 * | 9/2007 | Hooper | 220/1.5 |

* cited by examiner

*Primary Examiner* — S. Joseph Morano
*Assistant Examiner* — Jason C Smith
(74) *Attorney, Agent, or Firm* — Fitch, Even, Tabin & Flannery

(57) ABSTRACT

Disclosed are a method and an assembly for bulk transport. An inflatable bladder is inserted into a container and disposed proximal and above a gravity-fed aperture. The container may be, for instance, a hopper rail car. A bulk material then is introduced into the container, the bulk material being, for instance, a grain-based material such as corn gluten feed. The bladder is positioned and preferably secured laterally with respect to the aperture to impede access to the aperture by the bulk material. When the container has reached the transport destination, the bladder is deflated. If the bulk material has set up during transport, access to the aperture nonetheless will have been maintained.

12 Claims, 5 Drawing Sheets

RAIL CAR AND METHOD FOR TRANSPORT OF BULK MATERIALS

BACKGROUND OF THE INVENTION

Many bulk products are shipped by rail. Numerous bulk products, in particular grain-derived products, are shipped in rail hopper cars. Conventionally, a hopper car has at least one gravity-fed hopper, and typically three or four hoppers, positioned at the lower vertical extremity of the container portion of the rail car. Each hopper terminates in a gated aperture. In use, bulk material is introduced to the rail car for shipment. When the rail car has reached its destination, the gates of the hoppers are opened to allow the bulk material contained within the rail car to be released.

Many bulk products, in particular grain-derived products, will harden or "set up" during transport. In such event, the bulk material will not be present in a loose aggregate form suitable for release through the hopper, but instead will be in the form of a solid cohesive mass that will require manual breakup in order to be released. This problem is both inconvenient and dangerous. For the rail car worker, it can be time consuming and dangerous to enter a rail car to breakup the solidified bulk material, particularly when the material is a toxic product, such as a fertilizer. For the shipper of the material, the quality or choice of formulation of the material can be limited by set up concerns. For instance, shippers of corn gluten feed typically choose to limit the amount of sugar in the bulk shipment, because it is known that sugar will contribute to the set up phenomenon.

A general object of the present invention is to provide, in one embodiment, a method and in another embodiment, an assembly, that mitigates against the foregoing problem.

THE INVENTION

The inventors have discovered that an inflatable bladder may be inserted into a container and positioned over the gravity-fed aperture, such as the discharge gate of a hopper of a rail car. After inflation of the bladder and positioning of the bladder over the aperture, bulk material is introduced into the container. Preferably, the bladder is sized such that, upon filling of the container with a bulk material, the upper boundary surface of the bladder is higher than the vertical height of the bulk material in the container but below the roof of the rail car. The bladder thereby at least substantially impedes access to the aperture by the bulk material. When the container has been transported to its destination, the bladder is deflated. If the material has set up during transport, access to the aperture from above is nonetheless maintained.

The invention is deemed to find applicability to any type of transport container and any type of bulk material to be transported, but the invention is deemed to find particular applicability to rail cars, and is deemed especially suited for transport of grain-based materials and fertilizers. In other preferred embodiments, other bulk materials, such as concrete, lime, and so forth are transported.

Both a method for bulk transport and a transport assembly are encompassed by the present invention. Further details of the preferred embodiments of the invention are set forth hereinbelow.

DETAILED DESCRIPTION OF THE PREFERRED EMBODIMENTS

Figure 1:
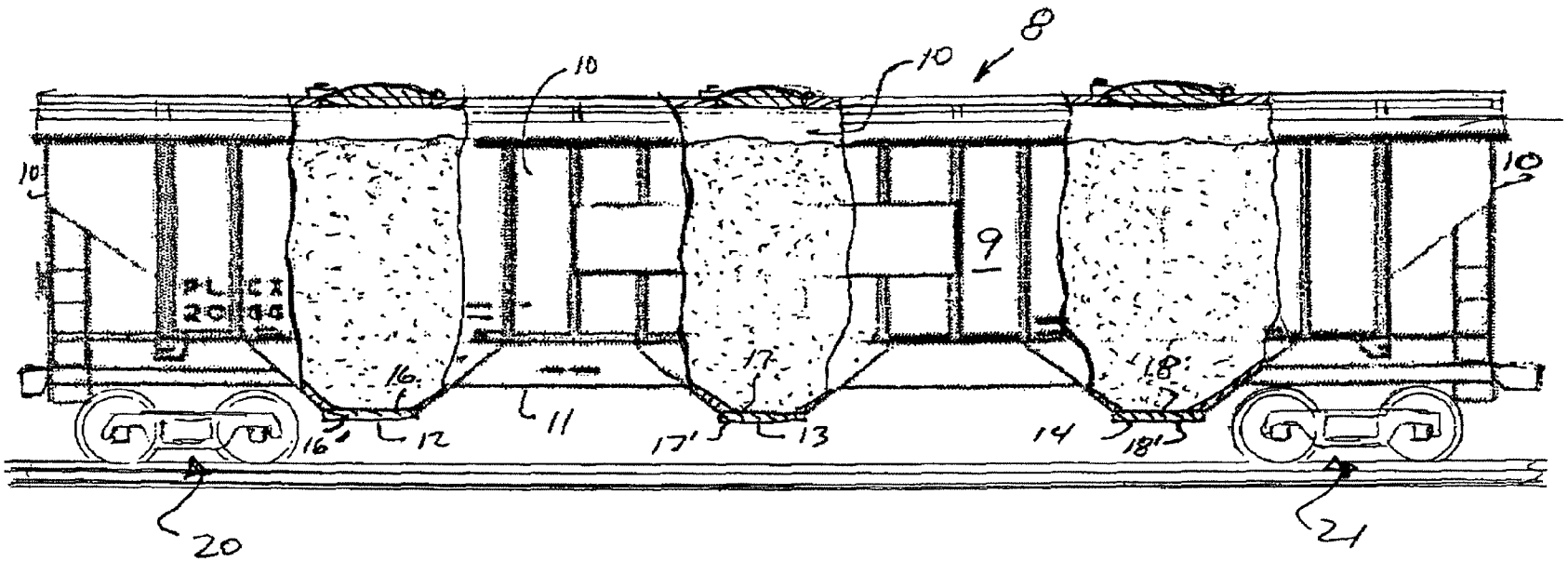
FIG. 1 PRIOR ART
FIG. 1, representing prior art, is a side elevational view, partially cut away, of a hopper car containing grain.

The present invention is described with respect to a rail car, but it is contemplated that the invention is applicable to any bulk transport container. Generally, the container comprises a wall surface that defines a container volume. As shown, for instance, in FIG. 1, the rail car 8 has a container portion 9 that comprises side walls 10 and a bottom surface 11. The bottom surface 11 is provided with a hopper (in the illustrated embodiment three hoppers 12, 13, 14 are shown). The rail car may be partitioned into plural separate volumes, with each hopper corresponding to one of the separate volumes. Each hopper terminates in an aperture 16, 17, 18, the aperture being disposed at the lowest vertical point of the container. The hoppers each are provided with a gate 16', 17', 18' that may be opened or closed; in preferred embodiments, the hopper and gate are conventional. The gate of the hopper is closed for filling and transport of the bulk material, and is opened when it is desired to empty the rail car. In other respects, the rail car 8 shown in FIG. 1 is conventional, and includes wheel truck assemblies 20, 21 and other conventional features. As shown, the rail car contains a bulk material, such as grain.

Figures 2, 2A:
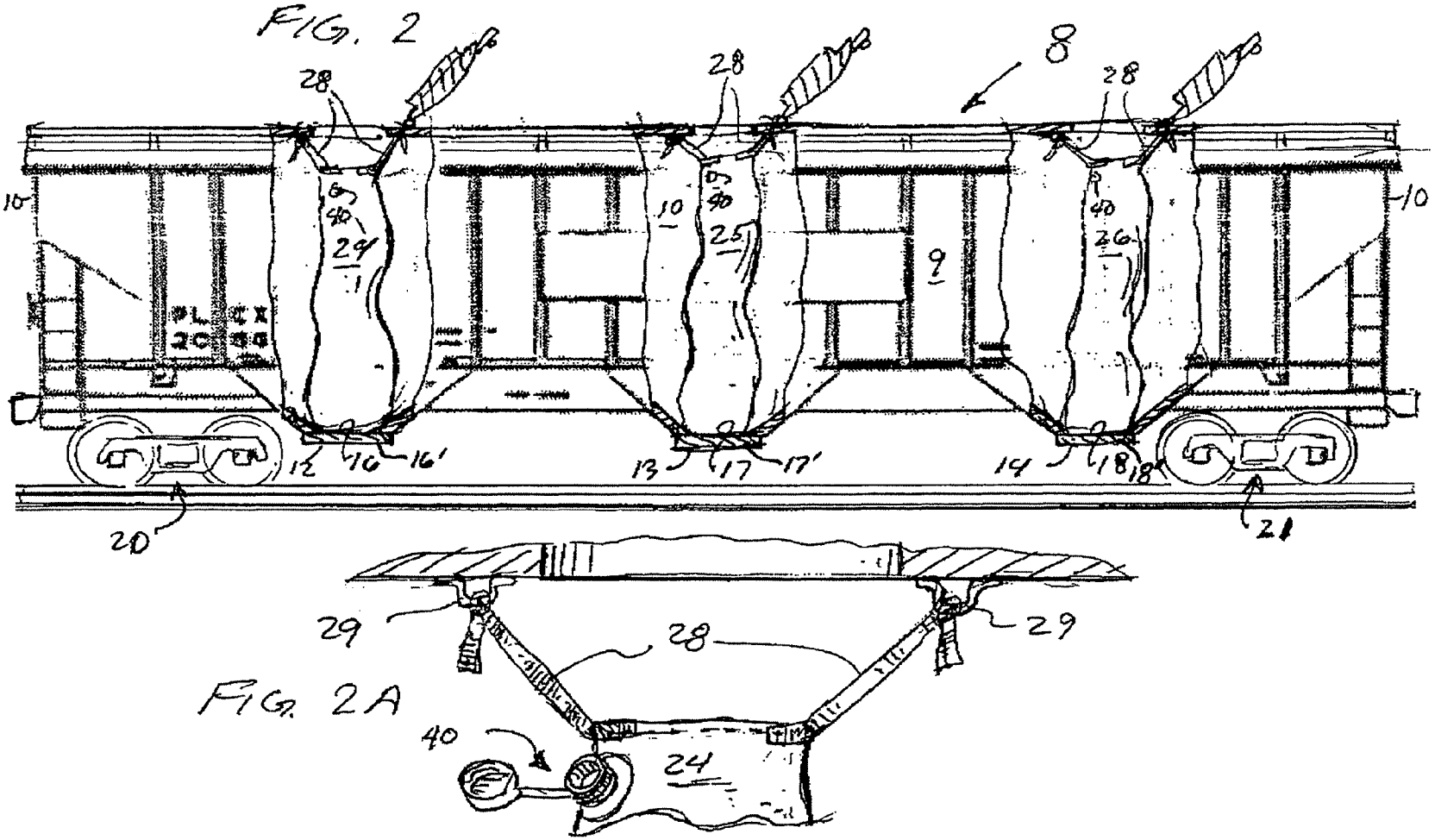
FIG. 2 is a side elevation, partially cut away, of a hopper car that contains plural bladders, one bladder being positioned over each of the hoppers in the car.
FIG. 2A is a top view of the hopper car as shown in FIG. 2.

As shown in FIG. 2, the assembly 22 of the invention includes the rail car 8 and three inflatable bladders 24, 25, 26, each bladder positioned respectively over the discharge gate of a hopper. Each bladder preferably is provided with one or more retaining straps 28 (shown with respect to bladder 24), which assist in securing the bladder laterally with respect to the hopper 12. The bladders are shown not having been inflated prior to placement in the rail car, but in practice, the bladders may or may not be inflated. As shown in FIG. 2A, the straps are preferably secured to a roof portion 29 of the rail car roof, such as the hinge pin of a roof car lid.

Figure 3:
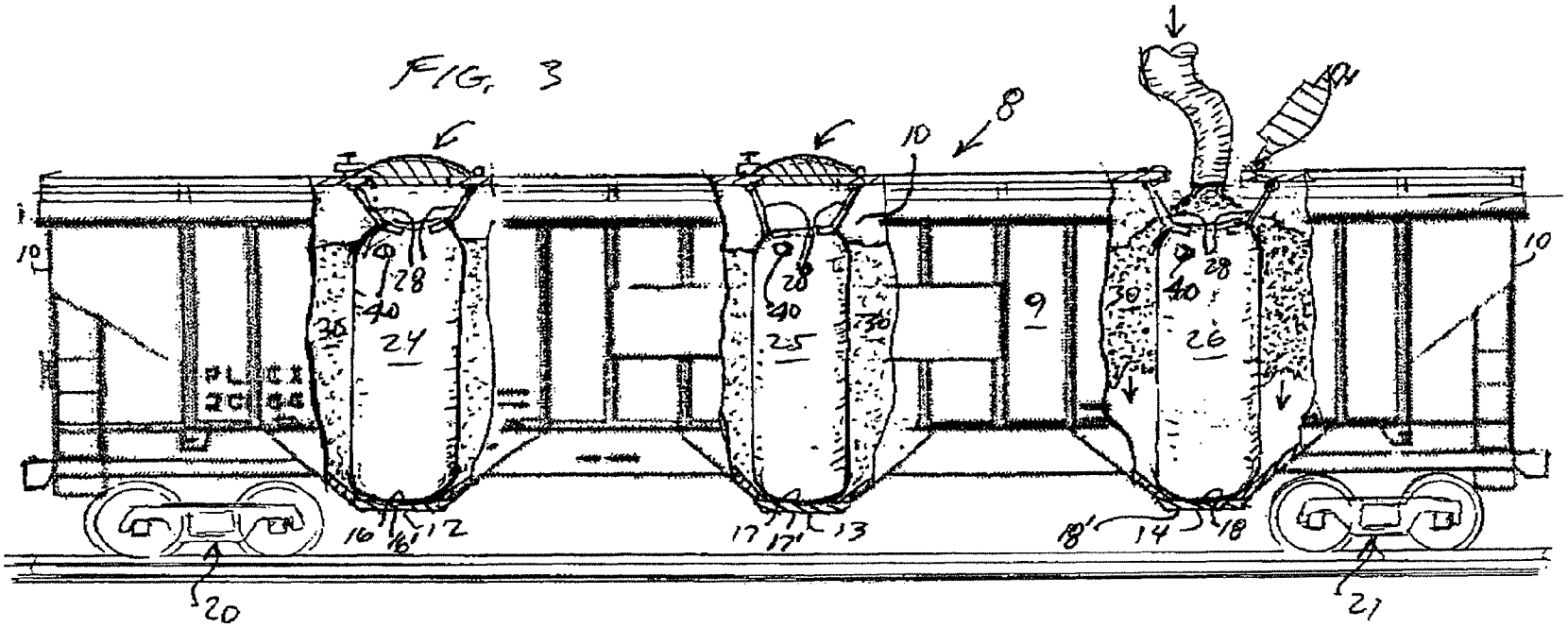
FIG. 3 is a side elevation, partially cut away, of the hopper car shown in FIG. 2, shown after the car has been filled with grain.

As shown in FIG. 3, after positioning of the bladder with respect to the hopper, the rail car is filled with the bulk material 30. It is contemplated that the bladder can be inflated either before or after the bladder is introduced into the rail car, but in either case the bladder should be inflated prior to introducing the bulk material. The bladder should be positioned in the rail car to impede access to the aperture of the hopper by the bulk material.

Figure 4:
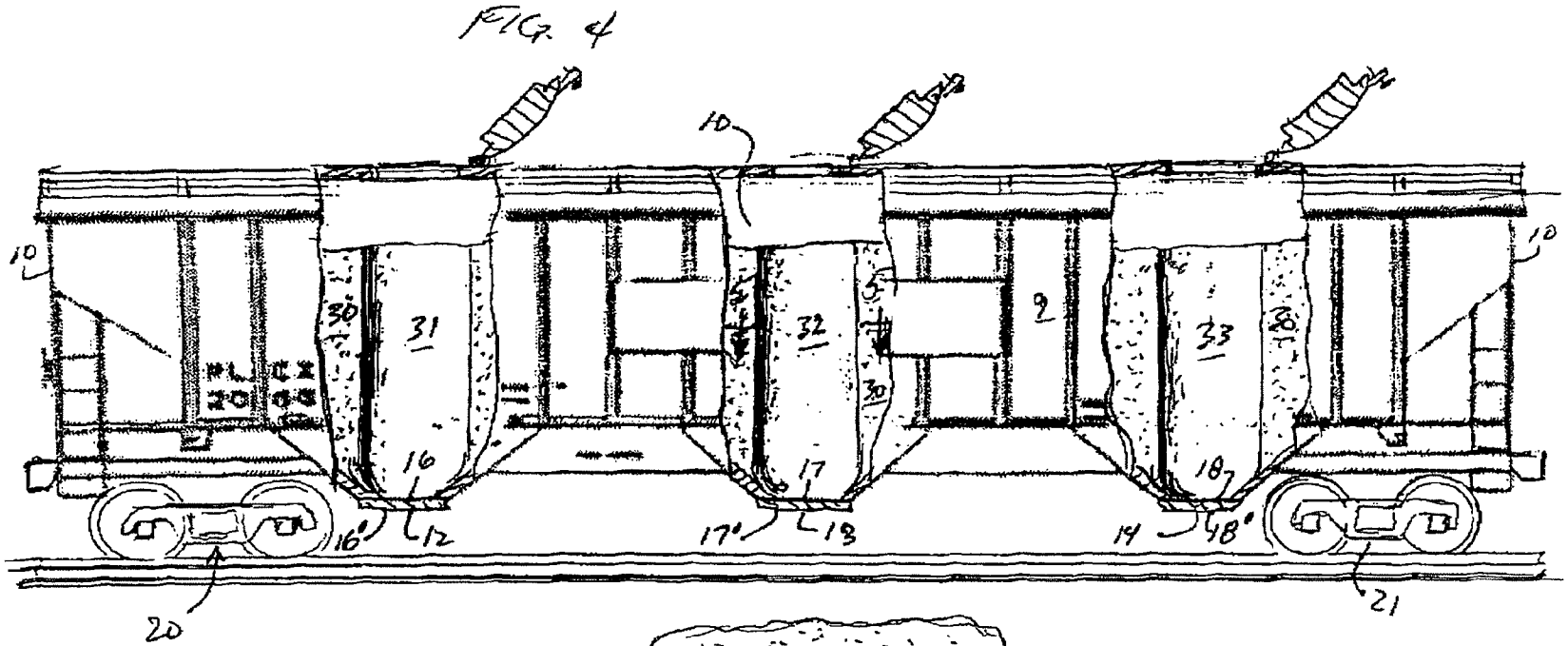
FIG. 4 is a side elevation of the hopper car shown in FIGS. 2 and 3, shown after the hopper car has reached its destination and after deflation and removal of the bladders.
Figure 5:
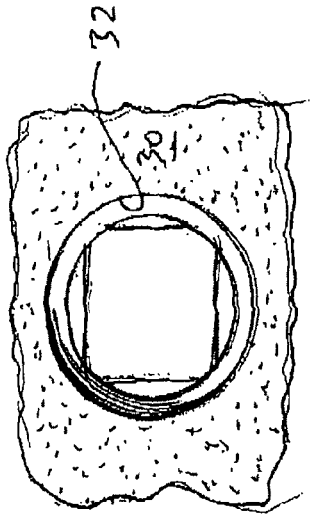
FIG. 5 is a top view of the hopper car illustrated in FIG. 4.

As shown in FIG. 4, in this embodiment the bulk material 30 contained in the rail car has set up to at least some extent during transport. The bladder has been deflated and removed from the rail car to leave a plurality of voids 31, 32, 33. Although the material in the rail car has set up, there nonetheless exists access to the hoppers as shown in FIG. 4 and FIG. 5. In practice, it has been observed that the bulk material will either begin to spontaneously crumble and descend into the hopper once the bladder has been removed. In any event, there is no need to "burrow" down from the top of the car to the discharge gate hopper to gain access thereto and to begin discharging material from the car. It likewise has been observed that occasionally some of the bulk material may work its way underneath the bladder, i.e., between the bladder and the aperture, during transport. Such cases are deemed to fall within the purview of the invention, because access to the aperture by the bulk material still will have been substantially impeded by the bladder. When this happens, the void can be accessed from the top or bottom of the rail car by manually removing the volume of bulk material that remains between the void and discharge gate. When the bladder has been deflated, it is not necessary to evacuate the bladder completely; preferably, the bladder is removed from the rail car, and is deflated to the extent necessary to allow removal of the bladder from the rail car.

Figure 6:
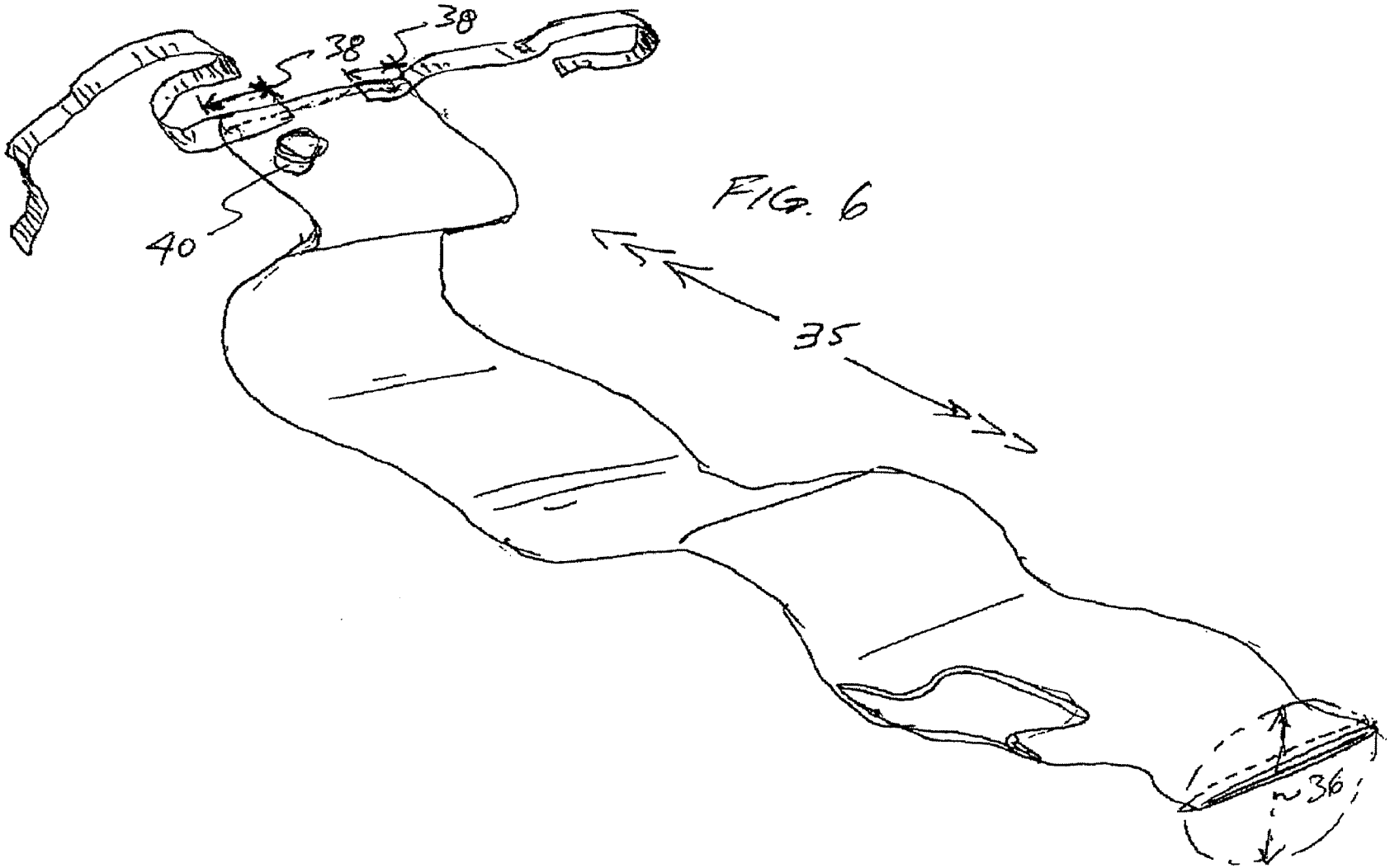
FIG. 6 is a perspective view of a deflated bladder of the type shown in FIGS. 2-5.

As shown in more detail in FIG. 6, the bladder 34 is preferably in the form of a sealed cylindrical tube having a length 35 sized to exceed the expected height of the bulk material in a rail car (but sufficiently short to allow the roof of the car to close), and a rough diameter 36 sufficient to cover the hopper and to impede access thereto. In practice, the bladder may have a length of approximately 172 inches and diameter of 30 inches when inflated. The bladder may be constructed of any suitable material. In preferred embodiments, the bladder is constructed of a polymeric material. One preferred bladder is composed of a laminate of polyethylene and uncoated polypropylene, the material being folded and sealed such that the polypropylene layer becomes the external layer of the bladder. The seams may be formed in any manner suitable to render the bladder airtight.

The bladder may be equipped with any suitable means or mechanism to inhibit lateral movement of the bladder. Preferably, the bladder is equipped with two pieces of one inch webbing, each having a length of at least eight or nine feet sewn into the bladder with a sewn length 38 of at least six inches, and each piece may be attached at a corner of what will become the upper end of the bladder. The bladder is provided with an inflation valve 40 that allows for inflation and deflation of the bladder, the valve 40 being proximal the upper end of the bladder. Numerous other configurations are deemed suitable for use in conjunction with the invention.

In other embodiments, the container may be a container other than a rail car, and the bladder may be otherwise configured. Those of skill in the art will appreciate that many other extensions and modifications of the invention are possible.

It is thus seen that the preferred embodiments of the invention satisfy the heretofore stated general objects.

While particular embodiments of the invention have been described above, the invention is not limited thereto, and it is contemplated that numerous other configurations and embodiments are possible. The description herein of preferred embodiments and of exemplary embodiments should not be construed as limiting the invention in scope. Similarly, no unclaimed language should be deemed to limit the invention in scope. The invention is deemed to be defined by the full scope of the following claims, including without limitation any equivalents that may be accorded under applicable law.

What is claimed is:

1. A method for bulk transport, comprising:

providing a bulk shipping container having at least one gravity-fed closable aperture;

providing an inflatable bladder;

positioning said bladder above said aperture;

after inflation of said bladder, introducing a bulk material into said container, whereby said bladder at least substantially impedes access by said bulk material to said aperture;

transporting said container to a destination before deflating said bladder; and after transporting said container to said destination, deflating said bladder leaving a void in said bulk material.

2. A method according to claim 1, said container comprising a rail car.

3. A method according to claim 2, said bladder having an upper bound and a lower bound, said method including position said lower bound proximal said aperture; said bulk material being introduced into said rail car at a height not exceeding the height of said upper bound.

4. A method according to claim 2, said bulk material comprising a grain-based material.

5. A method according to claim 4, said grain-based material comprising corn gluten feed.

6. A method according to claim 2, said bulk material comprising a fertilizer.

7. A method according to claim 1, comprising inflating said bladder before positioning said bladder above said aperture.

8. A method for bulk transport, comprising:

providing a bulk shipping container having at least one gravity-fed closable aperture;

providing an inflatable bladder;

positioning said bladder above said aperture;

after inflation of said bladder, introducing a bulk material into said container, whereby said bladder at least substantially impedes access by said bulk material to said aperture, said bladder having an upper bound and lower bound, said method including positioning said lower bound proximal said aperture; said bulk material being introduced into said container at a height not exceeding the height of said upper bound;

transporting said container to a destination before deflating said bladder; and deflating said bladder leaving a void in said bulk material.

9. A method according to claim 8, said bulk material comprising a grain-based material.

10. A method according to claim 9, said grain based material comprising corn gluten feed.

11. A method according to claim 8, said bulk material comprising a fertilizer.

12. A method according to claim 8, comprising inflating said bladder before positioning said bladder above said aperture.

* * * * *